US006394584B1

(12) United States Patent
Lerat et al.

(10) Patent No.: US 6,394,584 B1
(45) Date of Patent: May 28, 2002

(54) PRINT DEVICE USING HYDROPHILIC/ HYDROPHOBIC POLYMERS

(75) Inventors: Yannick J. Lerat; Olivier J. Poncelet, both of Chalon sur Saone; Thierry Vachette, Esbarres, all of (FR)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/361,942

(22) Filed: Jul. 27, 1999

(30) Foreign Application Priority Data

Jul. 28, 1998 (FR) ..... 98 09810

(51) Int. Cl.[7] ..... B41J 2/04
(52) U.S. Cl. ..... 347/54
(58) Field of Search ..... 347/55, 151, 120, 347/141, 154, 103, 123, 111, 159, 127, 128, 131, 125, 158, 68, 70, 71, 72, 50, 40, 44, 47, 27; 399/271, 290, 292, 293, 294, 295, 261; 361/700

(56) References Cited

U.S. PATENT DOCUMENTS 4,117,497 A 9/1978 McGroddy et al.
5,278,126 A 1/1994 Katano et al.
5,992,820 A * 11/1999 Fare et al.

FOREIGN PATENT DOCUMENTS

WO WO 91/15526 10/1991

OTHER PUBLICATIONS

Patent Abstract of Japan JP 60 110709, Mizoguchi Kensaku, Thermally Reversible Hydrophilic–Hydrophobic Material Having N–Cyclopropylacrylamido Group as Side Chain and its Production; Jun. 17, 1985, vol. 9, No. 260.

Patent Abstracts of Japan JP 08 230232, Taguchi Nobuyoshi, Image Forming Method, Sep. 10, 1996, vol. 097, No. 001.

Patent Abstracts of Japan JP 04 021844; Oyama Masaharu, Image Forming Device, Jan. 24, 1992, vol. 016, No. 182 (P–1346).

Patent Abstracts of Japan JP 61 219661, Hosaka Yasuo, Liquid Jet Recorder, Sep. 30, 1986, vol. 011, No. 064.

Patent Abstracts of Japan JP 61 219656, Hasaka Yasuo, Liquid Jet Recorder, Sep. 30, 1986, vol. 011, No. 064.

Patent Abstracts of Japan JP 61 219654, Ono Tadayoshi, Ink Jet Recorder, Sep. 30, 1986, vol. 011, No. 064.

Masahiko Sakai et al, Effects of Surfactants on the Phase Transition of a Hydrophobic Polymer Gel, Languimuir, 1995, vol. 11, No. 7, pp. 2493–2495.

* cited by examiner

*Primary Examiner*—Raquel Yvette Gordon
(74) *Attorney, Agent, or Firm*—Milton S. Sales

(57) ABSTRACT

A printing device comprising a polymer element capable of switching from an initial state to a final state when subjected to an event, the initial state and the final state being selected from an hydrophilic state and an hydrophobic state provided that the initial state differs from the second state, wherein said polymer element is impregnated with a print fluid, and a controller adapted to generate the event producing the switch of the polymer element, provided that the event is an optical, a thermal or a chemical event, wherein the controller is adapted to generate the event producing the switch of the polymer element on a localized zone and on a internal zone delimited by the localized zone, in order to form a fluid drop at the surface of the polymer element.

15 Claims, 4 Drawing Sheets

PRINT DEVICE USING HYDROPHILIC/ HYDROPHOBIC POLYMERS

FIELD OF THE INVENTION

The present invention relates to a printing device, specifically, to an ink jet printing device. The present invention also relates to a printing process using such a device.

BACKGROUND OF THE INVENTION

The object of almost all the printing technologies developed today is to produce high quality copies as fast as possible, at the lowest possible cost.

The printing process, in technologies relevant to thermal ink jet heads, conventionally has two steps. The first step consists in forming an ink drop and the second step consists in ejecting the ink drop from the ink jet head towards a receiving support. The formation of the ink drop requires raising the ink found in a channel to a high temperature in a very short time. This method requires heat in the volume of the ink jet head itself, which must then be dissipated. The drop can be ejected by different techniques, for example by the application of an electrostatic field.

One of the ink jet technologies in order to achieve fast printing consists in the use of a plurality of nozzles on the head surface that can eject ink drops in order to print a larger number of points in parallel on the receiving support. However, the number of nozzles on the head surface is restricted either because of problems related to heat dissipation in methods that consist in carrying high temperature ink as in the technologies developed by Canon and Hewlett Packard, or because of problems related to dimensional instability due to the vibrations caused by the use of piezoelectric technologies like those developed by Seiko-Epson.

Among the known methods, print devices have to be developed containing micro-elements that are generally very costly.

In ink jet technologies, the main issues are to improve the printing quality, cost and speed.

SUMMARY OF THE INVENTION

The present invention proposes the provision of a new printing device using polymers exhibiting specific properties.

The present invention relates to a printing device comprising a polymer element capable of switching from an initial state to a final state when subjected to an event, the initial state and the final state being selected from an hydrophilic state and an hydrophobic state provided that the initial state differs form the second state, and a controller adapted to generate the event producing the switch on a localized zone of the polymer element.

The present invention also relates to a method that comprises impregnating with a printing fluid a polymer element capable of switching from an initial state to a final state when subjected to an event, the initial state and the final state being selected from an hydrophilic state and an hydrophobic state provided that the initial state differs form the final state, generating an event for producing the switch of the polymer element thus forming at the polymer surface a printing fluid drop, and contacting the drop fluid with a printing receiver element.

The present invention has the advantage of forming a heat dissipating ink jet head. In fact, the ink jet head is created at the moment of use and for the duration of this use. The printing device of the invention allows printing a low temperature, avoiding any problems relating to the heat dissipation. The invention device eliminates any need for complex mechanics such as those used in known ink jet heads. The device of the present invention has a low manufacturing cost.

BRIEF DESCRIPTION OF THE DRAWINGS

Other characteristics will appear on reading the following description, with reference to the drawings wherein.

DETAILED DESCRIPTION OF THE INVENTION

Figure 1A:
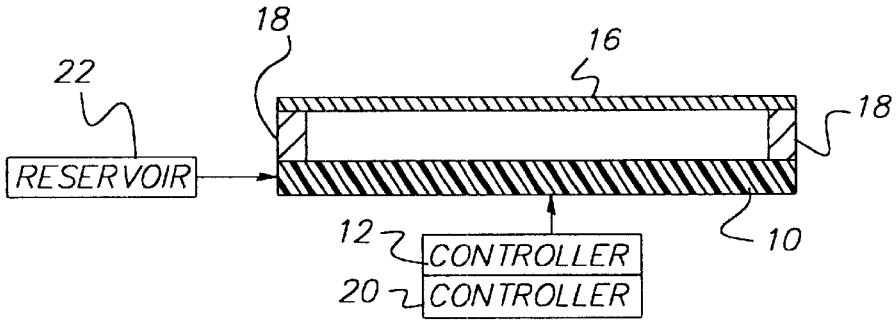
FIG. 1A is a representation of the device of the invention.

The polymer element of the invention can be a polymer element that is initially in a hydrophilic state and switches to turn into a hydrophobic state when subjected to an event producing the switch. The polymer element of the invention can also be a polymer element that is initially in a hydrophobic state and switches to turn into a hydrophilic state when subjected to the event producing the switch. These polymer elements are also able to switch from the final state to the initial stage when the event is released.

Polymer elements that can switch from an initial state to a final state when subjected to an event are well known in the art as switchable polymer. The event can be any event adapted to produce the switch of the polymer element from an initial state to a final state. The event that can be used is determined by the nature and the initial state of the polymer element. The event can be for example an optical event, a thermal event, electrical event or a chemical event. According to an embodiment, the polymer element of the invention is a thermo-reversible polymer. These elements are polymer elements capable of switching from an initial state to a final state when subjected to a thermal event such as heating or cooling, depending on the nature and the initial state of the polymer element. Conventionally, these polymers exhibit a phase transition temperature Tg. Depending on the initial state of the polymer, heating the polymer element above its Tg or cooling the polymer element below its Tg will provide the switch of the polymer element from the initial state to the final state. When the thermal event is released, the polymer element switches back to the initial state as soon as Tg is reached. The switch from the final state to the initial state can be expedited by subjecting the polymer element to an appropriate additional thermal event. According to a particular embodiment, the polymer element useful in the device of the invention is a polymer element initially in the hydrophilic state switching from a hydrophilic state to a hydrophilic state when the element is heated above its Tg, and which reverse back to the hydrophobic state when the heating is released and the polymer element returns at a temperature below Tg. The polymer can return to the hydrophilic state by simple heat dissipation.

According to a preferred embodiment, the polymer element of the invention is a thermo-reversible polymer that is hydrophilic at ambient temperature, and has a phase transition temperature between 20 and 100° C., preferably between 30 and 70° C. Thermo-reversible polymers that can be used in the present device are organic polymers such as those described in PCT Patent Application WO 91/15526. These are polymers that have a hydrophilic group and a hydrophobic group, the hydrophilic group being a water-soluble ionic polymerizable vinyl monomer, and the hydrophobic group comprising an acrylamide or methacrylamide monomer.

Other polymers that can be used are for example a poly(N-alkylacrylamide), a modified glycol polyethylene or a polysilylamine. Preferably a polymer will be used that switches from the initial state to a final state fast, for example poly(N-isopropylacrylamide).

Poly(N-isopropylacrylamide) has a temperature Tg of about 32°. When this polymer is at a temperature less than 32°, it is hydrophilic. When it exceeds 32°, it becomes hydrophobic.

According to the functions planned, the hydrophilic/hydrophobic phase transition temperature of a polymer can be modified by different means. For example adding a sufactant to the print fluid is known to increase the phase transition temperature. This technique is described in the publication, Langmuir, 1995, Volume 11, No. 7, pages 2493–2495. Thus the phase transition temperature Tg of poly(N-isopropylacrylamide) can be modified from 32° C. to 90° C.

It is known that the hydrophilic/hydrophobic change of state of some polymers, useful for the present invention, causes the polymer's volume to vary. According to the applications, it can be an advantage to be free of volume variations. Therefore, known techniques such as those described in Polymer Communications, "Synthesis of fast response, temperature-sensitive poly(N-isopropylacrylamide) gel", can be used.

The polymer element of the present device can be self-supporting. It can also be supported by a support. In this embodiment, the support has to transmit the event producing the switch. For example, when the event producing the switch is heating, the support need to be able to transfer the heat to the polymer element.

The controller of the invention can be any controller adapted to generate an event producing the switch of the polymer element from an initial state to a final state. The controller can be adapted to generate an optical event, a thermal event, electrical event or a chemical event, depending on the nature of the polymer element. According to an embodiment, the controller is adapted to generate the event producing the switch of the polymer element on a localized zone delimiting an internal zone, and then on the internal zone. The localized zone can be a continuous zone or a discontinuous zone. Examples of the controller producing the switch can be heating/cooling means, a laser, electrical means, chemical means such as means to alter the pH, means to alter the ionic force, or even mechanical means such as means to alter the pressure. When thermo-reversible polymer elements are used in the device of the invention, the controller is adapted to generate a thermal event. Heating means is for example an element comprising a thin layer of polycrystal silicon in which a current is made to flow adapted to generate a quantity of heat allowing the polymer to exceed its phase transition temperature for switching from a initial state to a final state. According to an embodiment, the controller is a laser beam and the polymer element is a thermo-reversible polymer element absorbing the laser's wavelength, typically 670 nm.

One or more controller adapted to generate the event producing the switch of the polymer element on the localized zone A and then the internal zone B can be used. For example when the controller is a laser beam, two independent laser beams can be used to switch the localized zone and then the internal zone B from the initial to the final second state. A single laser beam can also be used, whose beam is modulated to give minimum energy to the center of the beam and maximum to the sides.

In order to expedite the switch of the polymer from the final state to the initial state , the device of the invention can further contain an additional controller adapted to generate an appropriate event. This additional controller can be any controller adapted to generate the event producing the switch of the polymer element from the final state to the initial state. The additional controller can be adapted to generate an optical event, a thermal event, electrical event or a chemical event, depending on the nature of the polymer element. For example when the polymer element is a thermo-reversible polymer element initially hydrophilic capable of switching from an hydrophilic state to an hydrophobic state when subjected to heating, the additional controller will be means for cooling the polymer element, for example a fan or a pelletier effect device.

The device of the invention can also include means for feeding a fluid into the polymer element in order to maintain a constant impregnation of the polymer element with the fluid. This can be carried out by any known technique, for example with a fluid reservoir connected to the polymer, or for example by capillary diffusion. The fluid can be any known printing fluid containing organic or mineral pigments.

The device of the invention can further include means for positioning a fluid receiving material. The fluid receiving material that can be any material known in the printing domain, for example paper, whether coated or not, in sheet or roll form.

Figure 1B:
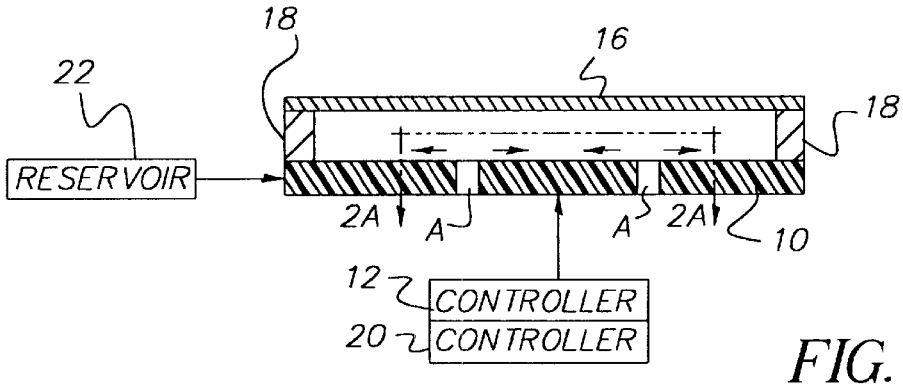
FIG. 1B is a representation of one embodiment of the device of the invention after having generated the event producing the switch of the polymer element in a localized zone A.

FIG. 1A shows a representation of the device of the invention which comprises a polymer element 10 impregnated with a fluid, a fluid receiving material 16, the fluid receiving material 16 being positioned in the device by means of positioning means 18, a controller 12, an additional controller 20 and means such as a reservoir 22 for feeding a fluid in the polymer element 10. As shown FIG. 1B, when a localized zone A of the polymer element in an initial state is subjected to a suitable event by means of the controller 12, the zone A of the polymer element switches from the initial state to the final state. The fluid initially present in the zone A tends to be pushed out of the zone A to a zone of the polymer element 10 still in the initial state, as shown by the arrows in FIG. 1B. In particular, the fluid is pushed into an internal zone B delimited by the zone A. It is thus obtained a localized zone A in the final state and a internal zone B in the initial state, impregnated with fluid.

Figure 1C:
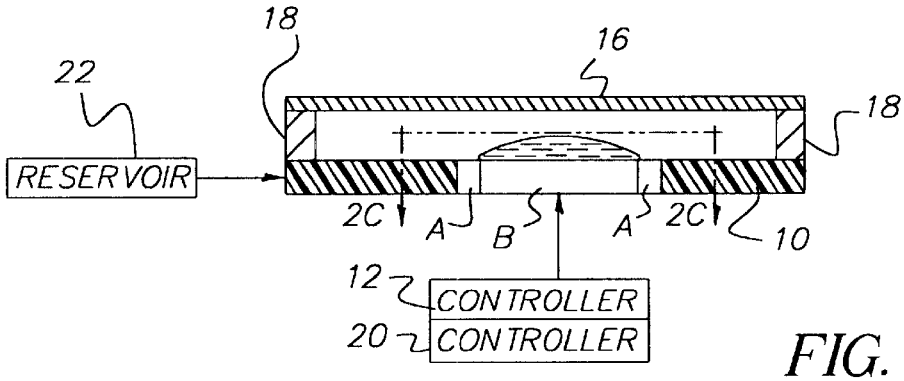
FIG. 1C is a representation of the device of the invention after having generated the event producing the switch in an internal zone B of the polymer element.

As illustrated in FIG. 1C, when then the internal zone B of the polymer element is subjected to the event, the zone B switches from the initial state to the final state, thereby moving the fluid contained in zone B outside the zone B toward the polymer surface opposed to the surface subjected to the event to form a fluid drop 14 at the surface of the polymer element.

A print is then obtained by contacting the fluid drop 14 at the surface of the zone B of the polymer element with the fluid receiving material 16. The fluid drop 14 can also be ejected from the surface to the fluid receiving material. The drop can be ejected for example by the application of an electric field, or by any known techniques.

Figure 2A:
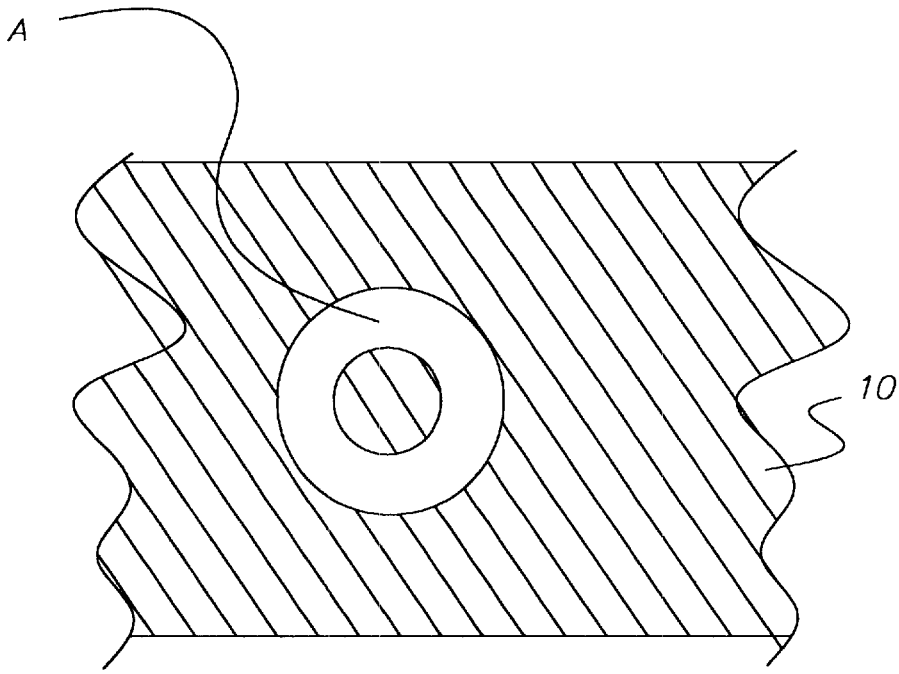
FIG. 2A is a cross-sectional view of a particular embodiment of a polymer element after having generated the event producing the switch of the polymer element in a localized zone A delimiting an internal zone.
Figure 2B:
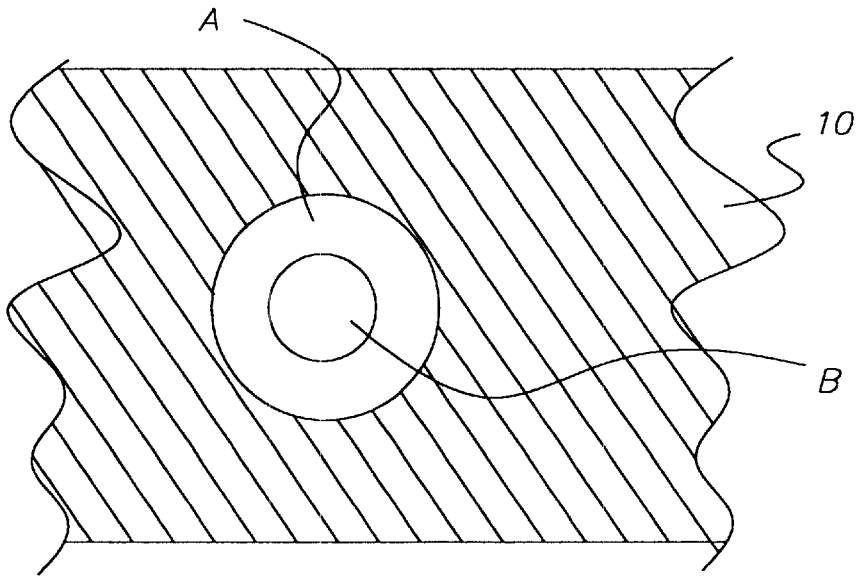
FIG. 2B is a cross-sectional view of a particular embodiment of a polymer element after having generated the event producing the switch of the polymer element in the internal zone B.

The zone A can be continuous or discontinuous. FIG. 2A shows an example of a polymer element after subjecting a localized continuous zone A to the event. FIG. 2B shows the same polymer element after subjecting the internal zone B to the event.

Figure 3A:
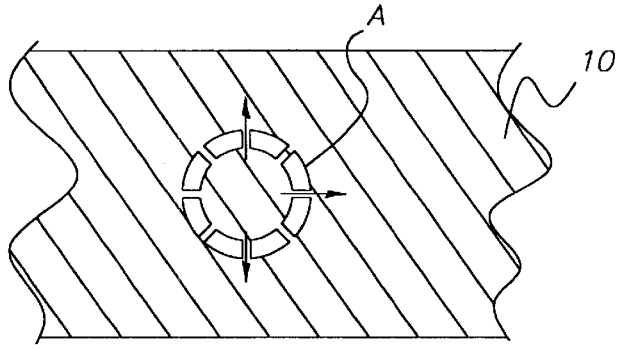
FIG. 3A is a cross-sectional view of a second embodiment of a polymer element after the having generated the event producing the switch of the polymer element in a localized zone A delimiting an internal zone B.

FIG. 3A shows an example of a polymer element after subjecting a localized discontinuous zone A to the event. When zone A is discontinuous, the fluid contained in the internal zone B can spread outside this zone, as shown by the arrows in FIG. 3A. In this case, the fluid present in the internal zone B is not completely isolated from the part of the polymer element in the initial state. Thus it can spread into the rest of the polymer still in the initial state. According to the size of the drop to be formed, it can be desirable to delay the application of the event to zone B until a desired quantity of fluid is released from the zone B to zone A.

Figure 3B:
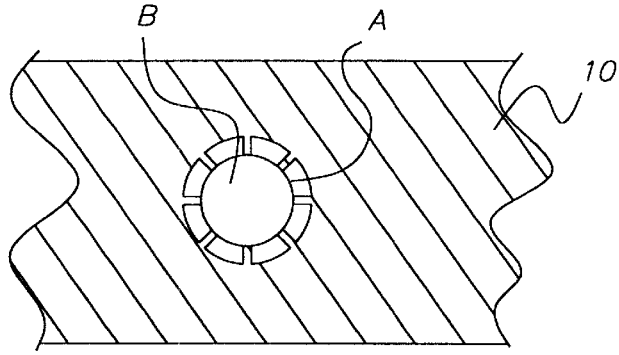
FIGS. 3B and 3C are cross-sectional views of particular embodiments of a polymer element after having generated the event producing the switch in the internal zone B of the polymer element.
Figure 3C:
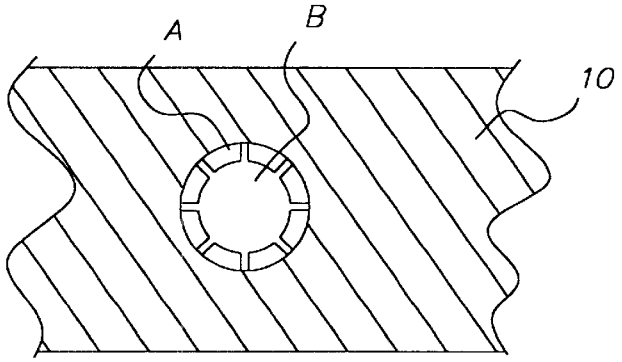
Figure 4:
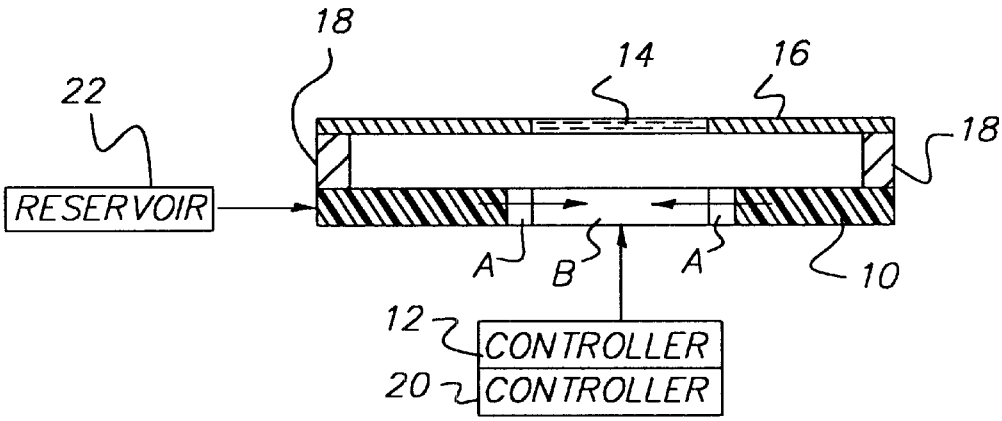
FIG. 4 is a representation of the device of the invention after printing.

FIG. 3B shows the same polymer element after subjecting the internal zone B to the event, when the zone A is a discontinuous localized zone.

After the transfer of the fluid drop 14 to the fluid receiving material 16 is completed, the event is released from the localized zone A and the internal zone B now in the final state, for example by deactivating the controller 12. The localized zone A and the internal zone B of the polymer element are then able to switch from the final state to the initial state. The polymer is thus able to be impregnated again with the fluid through the reservoir 22 for feeding the fluid to the polymer element 10. The switch from the final state to the initial state of the localized zone A and the internal zone B can also be expedited by subjecting the localized zone A and the internal zone B of the polymer element to a suitable event generated by the additional controller 20.

The device of the present invention can comprise a plurality of polymer elements as described above used successively. In fact, as the switch of the polymer element is not instantaneous, it can be helpful to use a device containing at least a second polymer element. According to this embodiment, the device can comprise means to move the plurality of polymer elements. The device of the invention can also comprise a continuous polymer element sheet, drawn by rollers. The polymer elements can be associated to form a cylinder. Rotating the cylinder allows the position of the various polymer elements to be simply changed in relation to the controller 12. The speed of rotation of the cylinder will be selected according to the suitable print speed and the time the polymer element switches from the final state to the initial state, when subjected to the suitable event.

Figure 5:
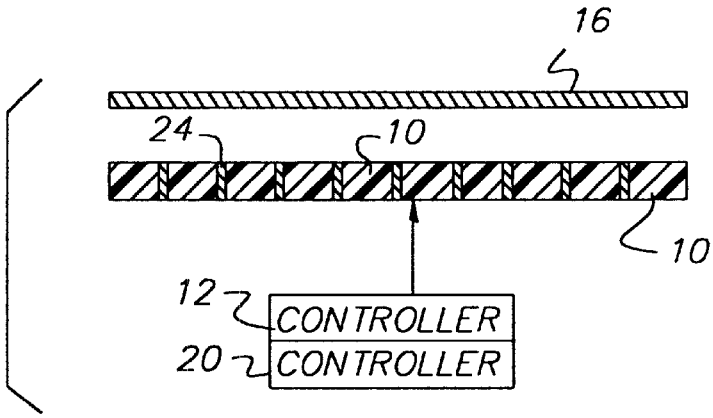
FIG. 5 is a different embodiment of the device of the invention.

As shown FIG. 5, the device of the invention can also comprise polymer elements 10 each separated from the others by a fluid insulating material 24. In that case, the entire unit is subjected to the event, the fluid insulating material 24 avoiding the spread of the fluid.

The fluid useful in the device of the invention is a print fluid, for example a hydrophilic or hydrophobic printing ink, containing pigments or organic dyes. The fluid will be selected to be able to impregnate the polymer element. For example, when the polymer element in the initial state is hydrophilic, the fluid will be a hydrophilic printing fluid on order to be fed to the polymer element. When the polymer element switches to the hydrophobic state, the fluid still hydrophilic tends to spread out of the hydrophobic zone, thereby forming the fluid drop on the surface of the hydrophobic zone of the polymer element. When the polymer element is initially hydrophobic, the printing fluid will be an hydrophobic printing fluid.

The invention has been described in detail with particular reference to certain preferred embodiments thereof, but it will be understood that variations and modifications can be effected within the spirit and scope of the invention.

PARTS LIST

10 polymer element
12 controller
14 fluid drop
16 fluid receiving material
18 means for positioning the fluid receiving material
20 additional controller
22 means for feeding the polymer with fluid
24 fluid insulating material

What is claimed is:

1. A printing device comprising:

a polymer element capable of switching from an initial state to a final state when subjected to an event, the initial state and the final state being selected from an hydrophilic state and an hydrophobic state provided that the initial state differs from the second state, wherein said polymer element is impregnated with a print fluid selected to be hydrophilic when the polymer element in the initial state is hydrophilic, or hydrophobic when the polymer element is in the initial state hydrophobic, and a controller adapted to generate the event producing the switch of the polymer element, provided that the event is an optical, a thermal or a chemical event, wherein the controller is adapted to generate the event producing the switch of the polymer element on a localized zone and on an internal zone delimited by the localized zone, in order to form a fluid drop at the surface of the polymer element.

2. The device according to claim 1 that further comprises means for feeding a fluid into the polymer element.

3. The device according to claim 1 that further comprises means for positioning a fluid receiving material.

4. The device according to claim 1 further comprising an additional controller adapted to generate an event producing the switch of the polymer element from the final state to the initial state.

5. The device according to claim 1 further comprising an additional controller adapted to generate an event producing the switch of the polymer element from the final state to the initial state.

6. The device according to claim 1 wherein the polymer element is a polymer element initially hydrophilic and capable of switching from the hydrophilic state to the hydrophobic state when subjected to the event.

7. The device according to claim 1 wherein the controller is adapted to generate a thermal event.

8. The device according to claim 7 wherein the controller is adapted to generate an increase of the temperature of the polymer element.

9. The device according to claim 7 comprising an additional controller adapted to generate the cooling of the polymer element.

10. The device according to claim 1 wherein the polymer element is a polymer element initially hydrophilic and capable of switching from the hydrophilic state to the hydrophobic state when subjected to a thermal event, and the controller is adapted to generate the thermal event producing the switch of the polymer element.

11. The device according to claim 1 wherein the controller is a laser beam.

12. The process according to claim 11 wherein the event is a thermal event.

13. A printing process that comprises impregnating with a printing fluid a polymer element capable of switching from an initial state to a final state when subjected to an event, the initial state and the final state being selected from an hydrophilic state and an hydrophobic state provided that the initial state differs form the final state, generating an event for producing the switch of the polymer element thus forming at the polymer surface a printing fluid drop, and contacting the printing fluid drop with a fluid printing receiver element.

14. A printing device comprising:

a polymer element capable of switching from an initial state to a final state when subjected to an event, the initial state and the final state being selected from an hydrophilic state and an hydrophobic state provided that the initial state differs from the second state, a controller adapted to generate the event producing the switch of the polymer element, wherein the controller is adapted to generate a thermal event, and an additional controller adapted to generate cooling of the polymer element.

15. A printing device comprising:

a polymer element capable of switching from an initial state to a final state when subjected to an event, the initial state and the final state being selected from an hydrophilic state and an hydrophobic state provided that the initial state differs from the second state, and a controller adapted to generate the event producing the switch of the polymer element, wherein the controller is a laser beam.

* * * * *